US012637750B2

(12) United States Patent
Sato et al.

(10) Patent No.: US 12,637,750 B2
(45) Date of Patent: May 26, 2026

(54) HOT-PRESSED MEMBER, STEEL SHEET FOR HOT PRESSING, AND METHOD FOR MANUFACTURING HOT-PRESSED MEMBER

(71) Applicant: JFE STEEL CORPORATION, Tokyo (JP)

(72) Inventors: Rinta Sato, Tokyo (JP); Minoru Tanaka, Tokyo (JP); Daisuke Mizuno, Tokyo (JP); Ryoto Nishiike, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 407 days.

(21) Appl. No.: 18/033,101

(22) PCT Filed: Jun. 29, 2021

(86) PCT No.: PCT/JP2021/024435

§ 371 (c)(1),
(2) Date: Apr. 21, 2023

(87) PCT Pub. No.: WO2022/091480

PCT Pub. Date: May 5, 2022

(65) Prior Publication Data

US 2023/0407449 A1 Dec. 21, 2023

(30) Foreign Application Priority Data

Oct. 28, 2020 (JP) ..... 2020-180530

(51) Int. Cl.

| | |
|---|---|
| ***C23C 2/40*** | (2006.01) |
| ***B21D 22/02*** | (2006.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/60*** | (2006.01) |
| ***C23C 2/06*** | (2006.01) |
| ***C25D 3/22*** | (2006.01) |
| ***C25D 5/50*** | (2006.01) |

(52) U.S. Cl.

CPC ..... *C23C 2/40* (2013.01); *B21D 22/022* (2013.01); *C21D 8/0247* (2013.01); *C21D 9/46* (2013.01); *C22C 38/001* (2013.01); *C22C 38/002* (2013.01); *C22C 38/02* (2013.01); *C22C 38/06* (2013.01); *C22C 38/26* (2013.01); *C22C 38/28* (2013.01); *C22C 38/32* (2013.01); *C22C 38/38* (2013.01); *C22C 38/60* (2013.01); *C23C 2/06* (2013.01); *C25D 3/22* (2013.01); *C25D 5/50* (2013.01)

(58) Field of Classification Search

CPC .... C23C 2/40; C23C 2/06; C23C 2/18; C23C 2/28; B21D 22/022; B21D 22/20; C21D 8/0247; C21D 9/46; C22C 38/001; C22C 38/002; C22C 38/02; C22C 38/06; C22C 38/26; C22C 38/28; C22C 38/32; C22C 38/38; C22C 38/60; C22C 38/04; C25D 3/22; C25D 5/50; C25D 5/028; C25D 5/16; C25D 5/605; C25D 7/0614; C25D 3/565; B32B 15/013

See application file for complete search history.

(56) References Cited

U.S. PATENT DOCUMENTS

2018/0216219 A1* 8/2018 Nakajima ..... C25D 5/48

FOREIGN PATENT DOCUMENTS

| | | | |
|---|---|---|---|
| DE | 26 46 697 | A1 | 4/1977 |
| DE | 10 2016 225 681 | A1 | 6/2018 |
| EP | 2 940 177 | A1 | 11/2015 |
| EP | 3 901 322 | A1 | 10/2021 |
| GB | 1 551 164 | A | 8/1979 |
| JP | S57-089494 | A | 6/1982 |
| JP | H01-177348 | A | 7/1989 |

(Continued)

OTHER PUBLICATIONS

Aug. 10, 2021 International Search Report issued in International Patent Application No. PCT/JP2021/024435.
Feb. 25, 2025 Office Action issued in Korean Patent Application No. 10-2023-7012477.
Feb. 2, 2024 Search Report issued in European Patent Application No. 21885603.7.
Aug. 30, 2025 Office Action issued in Chinese Patent Application No. 202180070951.4.
Oct. 24, 2025 Written Decision on Registration issued in Korean Patent Application No. 10-2023-7012477.

(Continued)

*Primary Examiner* — Adil A. Siddiqui
(74) *Attorney, Agent, or Firm* — Oliff PLC

(57) ABSTRACT

A hot-pressed member having excellent post-coating corrosion resistance and excellent resistance spot weldability, a method for manufacturing the hot-pressed member, and a steel sheet for hot pressing suitable for a hot-pressed member having excellent post-coating corrosion resistance and excellent resistance spot weldability. The hot-pressed member includes a Zn-based coated layer on a first side of a steel sheet, and a Zn-based coated layer on a second side of the steel sheet. A coating weight of Zn in the Zn-based coated layer on the first side of the steel sheet is 5 to 35 g/m$^2$, and an average line roughness Ra of a surface of the Zn-based coated layer on the first side is less than or equal to 2.5 μm. The average line roughness Ra of a surface of the Zn-based coated layer on the second side of the steel sheet is greater than or equal to 3.5 μm.

2 Claims, No Drawings

(56) References Cited

FOREIGN PATENT DOCUMENTS

| | | | |
|---|---|---|---|
| JP | H03-170694 | A | 7/1991 |
| JP | H04-00378 | A | 1/1992 |
| JP | 2695259 | B2 | 12/1997 |
| JP | 2004-323897 | A | 11/2004 |
| JP | 2011-246801 | A | 12/2011 |
| JP | 2013-503254 | A | 1/2013 |
| KR | 2015-0096513 | A | 8/2015 |
| KR | 10-2018-0021125 | A | 2/2018 |
| KR | 2020-0076309 | A | 6/2020 |
| WO | 2020/049833 | A1 | 3/2020 |

OTHER PUBLICATIONS

Feb. 25, 2026 Office Action issued in Chinese Patent Application No. 202180070951.4.

Metal composite materials: 20 Years of Manufacturing in China., Nov. 30, 2017.

* cited by examiner

HOT-PRESSED MEMBER, STEEL SHEET FOR HOT PRESSING, AND METHOD FOR MANUFACTURING HOT-PRESSED MEMBER

TECHNICAL FIELD

This application relates to a hot-pressed member, a steel sheet for hot pressing, and a method for manufacturing a hot-pressed member. In particular, the application relates to a hot-pressed member and a steel sheet for hot pressing having excellent post-coating corrosion resistance and excellent resistance spot weldability when a zirconium-based chemical conversion treatment is employed. The application also relates to a method for manufacturing such a hot-pressed member.

BACKGROUND

In recent years, in the field of automobiles, there has been a trend toward reducing the weight of material steel sheets as well as enhancing their performance. Accordingly, the use of a high-strength corrosion-resistant hot-dip galvanized steel sheet or a high-strength corrosion-resistant electrogalvanized steel sheet has been increasing. However, in many instances, when steel sheets have increased strength, they have reduced press formability, which makes it difficult to achieve complex shapes of parts. Regarding automotive applications, examples of parts that need to be corrosion-resistant and are difficult to form include supporting structures such as chassis, and frame components, such as B-pillars.

Under these circumstances, the use of hot pressing for the manufacture of automotive parts has been rapidly increasing in recent years because press formability and increased strength can be easily achieved in the case of hot pressing, compared with cold pressing. Accordingly, various techniques for solving problems associated with hot pressing techniques have been disclosed.

In particular, Zn—Ni alloy coated steel sheets are attracting attention as steel sheets for hot pressing because Zn—Ni alloy coated steel sheets have a high melting point of the coated layer. Thus, hot-pressed members in which such a steel sheet is used and methods for manufacturing the same have been proposed.

For example, Patent Literature 1 discloses a hot-pressed member including an α-Fe (Zn, Ni) mixed crystal, an intermetallic compound of Zn, Ni, and Fe, and a Mn-containing layer.

Furthermore, Patent Literature 2 discloses a hot-pressed member including a Ni-diffusion region, an intermetallic compound layer corresponding to a γ phase, and a ZnO layer.

CITATION LIST

Patent Literature

PTL 1: Japanese Unexamined Patent Application Publication (Translation of PCT Application) No. 2013-503254

PTL 2: Japanese Unexamined Patent Application Publication No. 2011-246801

PTL 3: Japanese Unexamined Patent Application Publication No. 2004-323897

SUMMARY

Technical Problem

In recent years, zirconium-based chemical conversion treatments have begun to be widely used instead of conventional zinc phosphate-based chemical conversion treatments. Accordingly, another need has arisen for post-coating corrosion resistance of members that have been subjected to a zirconium-based chemical conversion treatment and thereafter to electrodeposition coating.

The hot-pressed members disclosed in Patent Literature 1 and Patent Literature 2 are both hot-pressed members manufactured by heating a Zn—Ni alloy coated steel sheet. These hot-pressed members have excellent corrosion resistance when no additional coating is provided and have excellent post-coating corrosion resistance when a zinc phosphate-based chemical conversion treatment is employed. However, a problem exists in that their post-coating corrosion resistance when a zirconium-based chemical conversion treatment is employed is insufficient.

Resistance spot weldability is also an important property required of hot-pressed members. In instances where a Zn-based coated steel sheet is hot-pressed, the Zn, which is present in the coated layer before being heated, becomes oxidized in the hot pressing process, and as a result, an oxide film formed primarily of zinc oxide and having a thickness of several micrometers is formed on a surface. Zinc oxide is a semiconductor but has a high specific resistance and, therefore, reduces resistance spot weldability. For this reason, in hot-pressed members in which a zinc-based coated steel sheet is used, there are instances in which shot blasting or the like is used to remove the oxide film, as disclosed in Patent Literature 3. However, the shot blasting process for ensuring resistance spot weldability requires increased man-hours and increased costs and, therefore, presents a problem regarding the use of a zinc-based coated steel sheet in hot pressing.

The disclosed embodiments have been made in view of the circumstances described above, and objects of the disclosed embodiments are to provide a hot-pressed member having excellent post-coating corrosion resistance and excellent resistance spot weldability and to provide a method for manufacturing the hot-pressed member. Another object is to provide a steel sheet for hot pressing suitable for a hot-pressed member having excellent post-coating corrosion resistance and excellent resistance spot weldability.

Solution to Problem

To achieve the objects described above, the inventors diligently performed studies and made the following findings.

(1) An effective way to improve the post-coating corrosion resistance of a hot-pressed member is to ensure that a coating weight of Zn on one side of the hot-pressed member is 5 to 35 g/m$^2$, and an average line roughness Ra of a surface of a Zn coated layer on the one side is less than or equal to 2.5 μm, the one side being a side that is mainly to be evaluated for cosmetic corrosion. Furthermore, an effective way to improve the resistance spot weldability of the hot-pressed member is to ensure that the average line roughness Ra of a surface of a Zn coated layer on a different side of the hot-pressed member is greater than or equal to 3.5 μm, the different side being a side that mainly constitutes a mating surface for resistance spot welding.

(2) A hot-pressed member having excellent post-coating corrosion resistance and excellent resistance spot weldability can be produced by hot-pressing a steel sheet for hot pressing having Zn-based coated layers in which a coating weight of Zn on a first side is 5 to 35 g/m$^2$, and the coating weight of Zn on a second side is 40 to 120 g/m$^2$.

The disclosed embodiments are based on the findings described above, and features of the disclosed embodiments are as follows.

[1] A hot-pressed member including a Zn-based coated layer on a first side of a steel sheet; and a Zn-based coated layer on a second side of the steel sheet, wherein a coating weight of Zn in the Zn-based coated layer on the first side of the steel sheet is 5 to 35 g/m$^2$, an average line roughness Ra of a surface of the Zn-based coated layer on the first side is less than or equal to 2.5 μm, and the average line roughness Ra of a surface of the Zn-based coated layer on the second side of the steel sheet is greater than or equal to 3.5 μm.

[2] A steel sheet for hot pressing including a Zn-based coated layer on a first side of the steel sheet; and a Zn-based coated layer on a second side of the steel sheet, wherein a coating weight of Zn in the Zn-based coated layer on the first side of the steel sheet is 5 to 35 g/m$^2$, and the coating weight of Zn in the Zn-based coated layer on the second side of the steel sheet is 40 to 120 g/m$^2$.

[3] A method for manufacturing a hot-pressed member, the method using a steel sheet for hot pressing, the steel sheet for hot pressing including a Zn-based coated layer on a first side of the steel sheet and including a Zn-based coated layer on a second side of the steel sheet, wherein a coating weight of Zn in the Zn-based coated layer on the first side of the steel sheet is 5 to 35 g/m$^2$, and the coating weight of Zn in the Zn-based coated layer on the second side of the steel sheet is 40 to 120 g/m$^2$, the method including heating the steel sheet from room temperature to a temperature range of an $Ac_3$ transformation temperature to 1000° C. in a period of 5 seconds or more and 600 seconds or less; holding the steel sheet within the temperature range of the $Ac_3$ transformation temperature to 1000° C. for a period of 300 seconds or less; and subsequently hot-pressing the steel sheet.

Advantageous Effects

The disclosed embodiments can provide a hot-pressed member having excellent post-coating corrosion resistance and excellent resistance spot weldability. Furthermore, a steel sheet for hot pressing of the disclosed embodiments is suitable for hot-pressed members having excellent post-coating corrosion resistance and excellent resistance spot weldability.

DETAILED DESCRIPTION

Embodiments will be described below. Note that the disclosure is not intended to be limited to the following specific embodiments. Furthermore, regarding the chemical composition of steel, the contents of elements are all in mass %; hereinafter, the contents are expressed simply in % unless otherwise specified.

1) Hot-Pressed Member

A hot-pressed member of the disclosed embodiments includes a Zn-based coated layer on a first side of a steel sheet; and a Zn-based coated layer on a second side of the steel sheet. A coating weight of Zn in the Zn-based coated layer on the first side is 5 to 35 g/m$^2$, and an average line roughness Ra of a surface of the Zn-based coated layer on the first side is less than or equal to 2.5 μm. The average line roughness Ra of a surface of the Zn-based coated layer on the second side is greater than or equal to 3.5 μm. A significant feature of the disclosed embodiments is that the degree of surface roughness of the front and back surfaces of the hot-pressed member is intentionally differentiated.

The hot-pressed member of the disclosed embodiments includes the Zn-based coated layer on the first side of the steel sheet; and the Zn-based coated layer on the second side of the steel sheet. In instances where a steel sheet including a Zn-based coated layer is subjected to hot pressing, Zn in the coated layer diffuses into the base steel sheet, which results in the formation of a solid solution phase containing Fe and Zn, in the diffusion region. Note that the Zn-based coated layer may contain one or more other alloying elements. In some instances, Zn in the Zn-based coated layer may combine with oxygen present in a heating atmosphere, to form a Zn-containing oxide layer on the surface of the Zn-based coated layer. Furthermore, the Zn-based coated layer, which is an intermetallic compound, the portion that does not participate in the diffusion into the base steel sheet or the formation of the oxide layer remains as an intermetallic compound phase. Since Fe diffused from the base steel sheet is incorporated into the intermetallic compound phase, the intermetallic compound phase is one containing Zn, Fe, and one or more other alloying elements present in the coated layer. The solid solution phase and the intermetallic compound phase both contain Zn, which has a sacrificial corrosion protection effect, and, therefore, both the phases contribute to improving corrosion resistance. Accordingly, as described, the Zn-based coated layers are essential features for achieving post-coating corrosion resistance, which is an object of the disclosed embodiments. The Zn-based coated layers include at least one of the solid solution phase and the intermetallic compound phase.

In the disclosed embodiments, the coating weight of Zn in the Zn-based coated layer on the first side is 5 to 35 g/m$^2$, and the average line roughness Ra of the surface of the Zn-based coated layer on the first side is less than or equal to 2.5 μm. This side is an outer surface of the hot-pressed member and is a surface that is mainly to be evaluated for cosmetic corrosion properties. If the coating weight of Zn is less than 5 g/m$^2$, a corrosion rate of zinc under the coating is significantly increased, and, therefore, the post-coating corrosion resistance is reduced. Accordingly, the coating weight of Zn in the Zn-based coated layer is specified to be greater than or equal to 5 g/m$^2$. It is preferable that the coating weight of Zn in the Zn-based coated layer be greater than or equal to 10 g/m$^2$ so that the post-coating corrosion resistance and the resistance spot weldability can be further improved. More preferably, the coating weight of Zn is greater than or equal to 15 g/m$^2$. On the other hand, if the coating weight of Zn is greater than 35 g/m$^2$, a reaction with the electrode metal during resistance spot welding becomes intense, and, consequently, the possibility of the occurrence of cracking due to liquid metal embrittlement greatly increases. Accordingly, the coating weight of Zn in the Zn-based coated layer is specified to be less than or equal to 35 g/m$^2$. In instances where the post-coating corrosion resistance and the resistance spot weldability are to be further improved, the coating weight of Zn is preferably less than or equal to 28 g/m$^2$ and more preferably less than or equal to 25 g/m$^2$. The "coating weight of Zn in the Zn-based coated layer" is the weight of Zn present in the Zn-based coated layer. Furthermore, if a hot-pressed member with a high roughness, namely, an average line roughness of a surface of a Zn-based coated layer of greater than 2.5 μm, is subjected to a zirconium-based chemical conversion treatment and electrodeposition coating and then evaluated for post-coating corrosion resistance, significant formation of red rust is observed, particularly, in non-cross-cut general areas. A reason for this is believed to be that the electrodeposition coating does not conform to the roughness of the surface of the hot-pressed member, which results in a very thin film thickness of the electrodeposition coating on protruding portions, and red rust is formed in such portions. Accordingly, the average line roughness Ra of the surface of the Zn-based coated layer is specified to be less than or equal to 2.5 μm. The average line roughness Ra is preferably less than 2.2 μm, more preferably less than 2.0 μm, and even more preferably less than 1.6 μm. Furthermore, if the hot-pressed member has a low roughness, namely, an average line roughness of the surface of the Zn-based coated layer of less than 0.5 μm, the coating has reduced adhesion. Accordingly, the average line roughness Ra of the surface of the Zn-based coated layer is preferably greater than or equal to 0.5 μm and more preferably greater than or equal to 1.0 μm.

In the disclosed embodiments, the average line roughness Ra of the surface of the Zn-based coated layer on the second side is greater than or equal to 3.5 μm. This side is a side positioned opposite to the above-described first side (the side having the Zn-based coated layer in which the coating weight of Zn is 5 to 35 g/m$^2$, and the average line roughness Ra of the surface of the Zn-based coated layer is less than or equal to 2.5 μm); the side is an inner surface of the hot-pressed member and is a side that constitutes a mating surface for resistance spot welding (if the side on which the coating weight of Zn is 5 to 35 g/m$^2$, and the average line roughness Ra of the surface of the Zn-based coated layer is less than or equal to 2.5 μm is designated as a front surface of the steel sheet, the side on which the average line roughness Ra is greater than or equal to 3.5 μm can be designated as a back surface of the steel sheet). As described above, the member resulting from hot pressing has an oxide film formed on its surface. Since the oxide film has a high specific resistance, the thicker and more uniform the oxide film that is present, the greater the degree to which the resistance spot weldability is reduced. Specifically, in instances where a thick oxide film is present on the surface, a current flow path is narrowed, which destabilizes conduction, and, consequently, splash (burst) due to local conduction is generated at a relatively low welding current. Oxide films have high hardness but have low toughness, compared with metal films and electrode metals. For this reason, when the oxide film is pressed by an electrode or the steel sheet that is a joining member, the oxide film is easily broken. In this regard, the average line roughness Ra of the surface of the Zn-based coated layer on the second side is to be greater than or equal to 3.5 μm, and this facilitates, during resistance spot welding, breakage of the oxide film, which can occur when pressure is applied by electrodes, and, consequently, conductive points are ensured, which reduces the generation of splash. The average line roughness Ra is preferably greater than or equal to 3.7 μm and more preferably greater than or equal to 4.0 μm. Even more preferably, the average line roughness Ra is greater than or equal to 4.5 μm. Most preferably, the average line roughness Ra is greater than or equal to 5.0 μm. If the average line roughness Ra of the surface of the Zn-based coated layer is greater than 8 μm, an appearance of the coating is significantly degraded. It is preferable, from the standpoint of the appearance of the coating, that the average line roughness Ra of the surface of the Zn-based coated layer on the second side be less than or equal to 8 μm.

Preferably, the coating weight of Zn in the Zn-based coated layer having an average line roughness Ra of greater than or equal to 3.5 μm is 40 to 120 g/m$^2$.

2) Steel Sheet for Hot Pressing

A steel sheet for hot pressing of the disclosed embodiments includes a Zn-based coated layer on a first side of the steel sheet; and a Zn-based coated layer on a second side of the steel sheet. A coating weight of Zn in the Zn-based coated layer on the first side is 5 to 35 g/m$^2$, and the coating weight of Zn in the Zn-based coated layer on the second side is 40 to 120 g/m$^2$. The metal that forms the Zn-based coated layers may be non-alloyed zinc or a zinc alloy containing one or more alloying elements. For example, one or more selected from Mg, Al, Cr, Co, and Ni may be included in an amount of 0.1 to 20%. In this case, further improvement in the corrosion resistance can be expected. Furthermore, the Zn-based coated layer may include an oxide dispersed therein. For example, nanoparticles of $SiO_2$ or $Al_2O_3$ may be included in an amount of 0.1 to 10%.

The coating weight of Zn on the first side of the steel sheet for hot pressing is to be 5 to 35 g/m$^2$, and this enables the production of a hot-pressed member having excellent post-coating corrosion resistance. If the coating weight of Zn is less than 5 g/m$^2$, metallic-state Zn, which includes intermetallic-compound-state Zn, is dissipated as a result of oxidation or evaporation of zinc that occurs when the steel sheet is heated prior to hot pressing, and, consequently, it is impossible to produce a hot-pressed member having a desired post-coating corrosion resistance. In particular, blistering in coatings increases at edge surfaces or coating defect portions, and red rust is formed significantly in flawed portions. Accordingly, the coating weight of Zn is specified to be greater than or equal to 5 g/m$^2$. If the coating weight of Zn is greater than 35 g/m$^2$, the effect of inhibiting blistering in coatings no longer increases. Accordingly, the coating weight of Zn is specified to be less than or equal to 35 g/m$^2$. In instances where the post-coating corrosion resistance is to be further improved, the coating weight of Zn is preferably greater than or equal to 10 g/m$^2$, more preferably greater than or equal to 15 g/m$^2$, and even more preferably greater than or equal to 17 g/m$^2$. Furthermore, the coating weight of Zn is preferably less than or equal to 28 g/m$^2$, more preferably less than or equal to 25 g/m$^2$, and even more preferably less than or equal to 20 g/m$^2$.

The coating weight of Zn on the second side of the steel sheet for hot pressing (the side opposite to the side on which the coating weight of Zn in the Zn-based coated layer is 5 to 35 g/m$^2$) is to be 40 to 120 g/m$^2$, and this enables the production of a hot-pressed member having excellent weldability. If the coating weight of Zn is less than 40 g/m$^2$, the surface roughness after the heat treatment is low, and, consequently, it is impossible to produce a hot-pressed member having a desired resistance spot weldability. Accordingly, the coating weight of Zn is specified to be greater than or equal to 40 g/m$^2$. If the coating weight of Zn is greater than 120 g/m$^2$, the effect of improving weldability no longer increases, and in addition, liquid metal embrittlement cracking is highly likely to occur at the weld. Accordingly, the coating weight of Zn is specified to be less than or equal to 120 g/m$^2$. The coating weight of Zn is preferably greater than or equal to 45 g/m$^2$, more preferably greater than or equal to 55 g/m$^2$, and even more preferably greater than or equal to 65 g/m$^2$. Furthermore, the coating weight of Zn is less than or equal to 120 g/m$^2$. The coating weight of Zn is preferably less than or equal to 100 g/m$^2$, more preferably less than or equal to 90 g/m$^2$, and even more preferably less than or equal to 75 g/m$^2$.

The Zn-based coated layers of the steel sheet for hot pressing of the disclosed embodiments may each be a single layer of the Zn-based coated layer or be provided with an underlying film or an overlying film, depending on a purpose, as long as the effects and advantages of the disclosed embodiments are not adversely affected. Examples of the underlying film include an underlying coated layer formed primarily of Ni.

In the disclosed embodiments, for the steel sheet for hot pressing, a steel sheet having a chemical composition may be used as the base steel sheet for the Zn-based coated layer so that a hot-pressed member that has a strength greater than 1470 MPa after being hot pressed can be produced. The chemical composition contains, for example, in mass %, C: 0.20 to 0.50%, Si: 0.1 to 0.5%, Mn: 1.0 to 3.0%, P: 0.02% or less, S: 0.01% or less, Al: 0.1% or less, and N: 0.01% or less, with the balance being Fe and incidental impurities. Note that the steel sheet may be a cold rolled steel sheet or a hot rolled steel sheet. Reasons for the limitations on each of the components will be described below.

C: 0.20 to 0.50%

C improves strength by enabling the formation of steel microstructures, such as martensite. It is preferable that a C content be greater than or equal to 0.20% so as to achieve a strength greater than 1470 MPa. On the other hand, if the C content is greater than 0.50%, the toughness of a spot weld is reduced. Accordingly, it is preferable that the C content be less than or equal to 0.50%.

Si: 0.1 to 0.5%

Si is an element effective for strengthening steel, thereby producing a favorable material quality. For this purpose, it is preferable that Si be present in an amount greater than or equal to 0.1%. On the other hand, if a Si content is greater than 0.5%, ferrite is stabilized, which reduces hardenability. Accordingly, it is preferable that the Si content be less than or equal to 0.5%.

Mn: 1.0 to 3.0%

Mn is an element effective for ensuring a post-cooling strength for a wide cooling rate range. It is preferable that an Mn content be greater than or equal to 1.0% so as to ensure mechanical properties and the strength. On the other hand, if the Mn content is greater than 3.0%, costs increase, and in addition, the effects no longer increase. Accordingly, it is preferable that the Mn content be less than or equal to 3.0%.

P: 0.02% or less

If a P content is greater than 0.02%, P segregation at austenite grain boundaries during casting causes intergranular embrittlement, which results in degradation in local ductility, and, consequently, a balance between the strength and the ductility is reduced. Accordingly, it is preferable that the P content be less than or equal to 0.02%. Furthermore, if the P content is less than or equal to 0.001%, an effect of improving the balance between the strength and the ductility no longer increases, with the only result being an increase in the cost of refining. Accordingly, in terms of the cost of refining, it is preferable that the P content be greater than or equal to 0.001%.

S: 0.01% or less

S forms inclusions, such as MnS, which can cause degradation in impact resistance and cause cracking along a metal flow in the weld. Accordingly, it is desirable that S be reduced as much as possible; preferably, a S content is less than or equal to 0.01%. Furthermore, it is more preferable that the S content be less than or equal to 0.005% so as to ensure good stretch flangeability. Furthermore, in terms of the cost of refining, it is preferable that the S content be greater than or equal to 0.001%.

Al: 0.1% or less

If an Al content is greater than 0.1%, the blanking workability and the hardenability of the material steel sheet are reduced. Accordingly, it is preferable that the Al content be less than or equal to 0.1%. Furthermore, in terms of the cost of refining, it is preferable that the Al content be greater than or equal to 0.0001%.

N: 0.01% or less

If a N content is greater than 0.01%, a nitride of AlN is formed during hot rolling and/or the heating prior to hot pressing, and, consequently, the blanking workability and the hardenability of the material steel sheet are reduced. Accordingly, it is preferable that the N content be less than or equal to 0.01%. Furthermore, in terms of the cost of refining, it is preferable that the N content be greater than or equal to 0.0001%.

Furthermore, in the disclosed embodiments, at least one selected from Nb: 0.05% or less, Ti: 0.05% or less, B: 0.0002 to 0.005%, Cr: 0.1 to 0.3%, and Sb: 0.003 to 0.03% may be appropriately included, as necessary, in addition to the fundamental components described above, to further improve the properties of the steel sheet.

Nb: 0.05% or less

Nb is a component effective for strengthening steel, but including an excessive amount of Nb reduces shape fixability. Accordingly, in instances where Nb is to be included, it is preferable that a Nb content be less than or equal to 0.05%. Furthermore, in terms of the cost of refining, it is preferable that the Nb content be greater than or equal to 0.0001%.

Ti: 0.05% or less

Similar to Nb, Ti is effective for strengthening steel but presents a problem in that including an excessive amount of Ti reduces shape fixability. Accordingly, in instances where Ti is to be included, it is preferable that a Ti content be less than or equal to 0.05%. Furthermore, in terms of the cost of refining, it is preferable that the Ti content be greater than or equal to 0.0001%.

B: 0.0002 to 0.005%

B has an effect of inhibiting the formation and growth of ferrite from the austenite grain boundaries. Accordingly, it is preferable that a B content be greater than or equal to 0.0002%. On the other hand, including an excessive amount of B significantly impairs formability. Accordingly, in instances where B is to be included, it is preferable that the B content be greater than or equal to 0.0002%. Furthermore, it is preferable that the B content be less than or equal to 0.005%.

Cr: 0.1 to 0.3%

Cr is useful for strengthening steel and improving hardenability. It is preferable that a Cr content be greater than or equal to 0.1% so as to produce the effects. On the other hand, a Cr content of greater than 0.3% significantly increases costs because the alloy cost is high. Accordingly, in instances where Cr is to be included, it is preferable that the Cr content be greater than or equal to 0.1%. Furthermore, it is preferable that the Cr content be less than or equal to 0.3%.

Sb: 0.003 to 0.03%

Sb has an effect of inhibiting, in an annealing process for the blank sheet that is to be coated, decarburization in a surface layer of the steel sheet. Producing this effect requires that Sb be included in an amount greater than or equal to 0.003%. On the other hand, if an Sb content is greater than 0.03%, an increase in the rolling load occurs, which reduces productivity. Accordingly, in instances where Sb is to be included, it is preferable that the Sb content be greater than or equal to 0.003%. Furthermore, it is preferable that the Sb content be less than or equal to 0.03%.

The balance, other than the components described above, is Fe and incidental impurities.

3) Method for Manufacturing Steel Sheet for Hot Pressing

The manufacturing conditions for the steel sheet for hot pressing of the disclosed embodiments are not particularly limited; described below are desirable manufacturing conditions. A steel having the components described above is cast, and the resulting hot slab is subjected to hot rolling directly or after being heated, or after the slab that has been cooled is reheated. In this regard, there is substantially no difference between the properties resulting from the hot direct rolling of the hot slab and the properties resulting from the rolling after reheating. Furthermore, the temperature for reheating is not particularly limited and may be within a range of 1000° C. to 1300° C., which is preferable in terms of productivity. The hot rolling may employ a typical hot rolling process or a continuous hot rolling process in which finish rolling is carried out by rolling joined slabs. For the hot rolling, it is desirable, in terms of productivity and gauge accuracy, that the finish rolling temperature be greater than or equal to an $Ar_3$ a transformation temperature. After the hot rolling, cooling is performed in a typical manner. In this regard, it is preferable that a coiling temperature be greater than or equal to 550° C., from the standpoint of productivity. Furthermore, if the coiling temperature is excessively high, pickling properties are degraded, and, therefore, it is desirable that the coiling temperature be less than or equal to 750° C. For pickling and cold rolling, any known method may be used.

The zinc-based coatings, which are subsequently applied, may be applied with any method; the method is appropriately selected in accordance with the alloy system. In the instance of non-alloyed zinc or zinc-nickel alloy coatings, the application may be preferably performed by electroplating. In the instance of zinc-aluminum alloy coatings, the application may be preferably performed by hot-dip coating. In the instance of zinc-magnesium alloy coatings, the application may be preferably performed by vacuum vapor deposition. Furthermore, an alloying treatment may be performed after the application of the coating, and in this case, a coating alloyed with iron can be efficiently produced. Regarding an atmosphere for the coating process, typical conditions can be used for the application of the coating, either in the case of using a continuous coating line including a non-oxidizing furnace or a continuous coating line including no non-oxidizing furnace. No special control exclusively for the present steel sheet is necessary, and, therefore, productivity is not impaired.

Regarding the control of the coating weights of Zn on the first side (front surface) of the steel sheet and on the second side (back surface) of the steel sheet, an adjustment can be made such that the coating weights of Zn become different from each other, by, in the instance of electroplating, varying one or both of a current density and an electroplating time for the two sides. Furthermore, in the instance of hot-dip coating, an adjustment can be made such that the coating weights of Zn become different from each other, by varying, for the two sides, a flow rate of a wiping gas used for the gas wiping that follows the immersion in the coating bath.

4) Method for Manufacturing Hot-Pressed Member

In the disclosed embodiments, a desired hot-pressed member can be produced as follows. A steel sheet for hot pressing is used. The steel sheet is a steel sheet including a Zn-based coated layer on a first side of the steel sheet and including a Zn-based coated layer on a second side of the steel sheet; a coating weight of Zn on the first side of the steel sheet is 5 to 35 g/m$^2$, and the coating weight of Zn on the second side of the steel sheet is 40 to 120 g/m$^2$. The steel sheet is heated from room temperature to a temperature range of an $Ac_3$ transformation temperature to 1000° C. in a period of 5 seconds or more and 600 seconds or less. Then, the steel sheet is held within the temperature range of the $Ac_3$ transformation temperature to 1000° C. for a period of 300 seconds or less. Subsequently, the steel sheet is hot-pressed.

The heating temperature for the steel sheet for hot pressing is to be within the range of the $Ac_3$ transformation temperature to 1000° C., and this enables the production of the Zn-based coated layers described above in the section 1). If the heating temperature is less than the $Ac_3$ transformation temperature, a strength necessary for a hot-pressed member may not be achieved. If the heating temperature is greater than 1000° C., Zn may be dissipated. Note that the $Ac_3$ transformation temperature is a value calculated according to the following equation, based on the chemical composition.

$$Ac_3 \text{ transformation temperature } (^\circ\text{ C.}) = 910 - 203C^{1/2} + 44.7Si - 4Mn + 11Cr$$

In the equation, the element symbols each represent a content (mass %) of the element, and in the instance where the element is not included, the content is zero.

The time period required for the heating from room temperature to the heating temperature is to be less than or equal to 600 seconds. This is to enable the intermetallic compound phase to remain, thereby maintaining post-coating corrosion resistance. The time period required for the heating from room temperature to the heating temperature is preferably less than or equal to 450 seconds and more preferably less than or equal to 300 seconds. Furthermore, if the heating rate is excessively high, that is, the time period for the heating from room temperature to the heating temperature is too short, an amount of the intermetallic compound that remains no longer increases, and in addition, during the heating treatment, the coated layer may melt, which may result in the formation of coating streaks and, therefore, degradation in the appearance. Accordingly, regarding the heating time, the time period required for the heating from room temperature to the heating temperature is to be greater than or equal to 5 seconds. The time period is preferably greater than or equal to 10 seconds, more preferably greater than or equal to 100 seconds, and even more preferably greater than or equal to 150 seconds.

Furthermore, the holding time associated with the heating temperature is to be less than or equal to 300 seconds. This is to enable as much of the intermetallic compound phase as possible to remain, thereby further improving the post-coating corrosion resistance, and to avoid absorption of hydrogen that may be caused if water vapor present in the furnace is taken up during the holding time. The holding time is more preferably less than or equal to 180 seconds and even more preferably less than or equal to 60 seconds. It is most preferable that the holding be omitted.

Furthermore, methods for heating the steel sheet for hot pressing are not in any way limited. Examples of the methods include furnace heating that uses an electric furnace or a gas furnace, Joule heating, induction heating, RF heating, and flame heating.

After the heating, a hot pressing process is performed, and, simultaneously with or immediately after the process, cooling is performed in a die assembly or with a coolant, such as water. In this manner, the hot-pressed member is manufactured. In the disclosed embodiments, the conditions for the hot pressing are not particularly limited. The pressing may be performed at a temperature of 600 to 800° C., which is a typical temperature range for hot pressing.

Examples

The disclosed embodiments will now be described in detail with reference to examples. The examples described below are not intended to limit this disclosure. Making appropriate modifications within the scope of the primary features is encompassed by the scope of the disclosed embodiments.

The base steel sheet used was a cold rolled steel sheet having a sheet thickness of 1.4 mm ($Ac_3$ transformation temperature=848° C.). The base steel sheet had a chemical composition containing, in mass %, C: 0.24%, Si: 0.25%, Mn: 1.28%, P: 0.005%, S: 0.001%, Al: 0.03%, N: 0.004%, Nb: 0.02%, Ti: 0.02%, B: 0.002%, Cr: 0.2%, and Sb: 0.008%, with the balance being Fe and incidental impurities.

Zn-based coated layers were applied to both sides (front surface and back surface) of the base steel sheet by performing electroplating or hot-dip coating as described below. In this manner, steel sheets for hot pressing were produced.

<Electroplating>

Regarding Steel sheets Nos. 1 to 18, shown in Table 1-1, Zn—Ni-based alloy coated layers, which had a Ni content of 12% and were different in the coating weight of Zn, were formed as follows. An electroplating treatment was performed in a plating bath, which included 115 g/L of zinc sulfate heptahydrate, 230 g/L of nickel sulfate hexahydrate, and 55 g/L of sodium sulfate and had a pH of 1.4 and a bath temperature of 50° C. The current density was varied from 10 to 100 A/dm$^2$, and the electroplating time from 5 to 60 seconds. Furthermore, regarding Steel sheets Nos. 19 and 20, shown in Table 1-1, Zn-based coated layers were formed as follows. An electroplating treatment was performed in a plating bath, which included 200 g/L of zinc sulfate heptahydrate and 55 g/L of sodium sulfate and had a pH of 1.4 and a bath temperature of 50° C. The Zn-based coated layers having different coating weights for the front and back surfaces of the steel sheet were produced by using a different current density for each of the surfaces. The coating weight of Zn in the Zn-based coated layer on each of the surfaces of the steel sheet for hot pressing was measured as follows. The steel sheet for hot pressing to be evaluated was blanked to give three samples (φ=48 mm), and each of the samples was weighed. Subsequently, in each of the samples, a non-evaluation surface, which was opposite to the surface for which the coating weight of Zn was to be evaluated, was masked. Subsequently, the samples were immersed in a solution for 10 minutes. The solution was one obtained by diluting 500 mL of a 35% aqueous hydrochloric acid solution, which contained 3.5 g of hexamethylenetetramine added thereto, to 1 L. In this manner, the Zn-based coated layer was dissolved. Thereafter, each of the samples was weighed again. The metal components in the hydrochloric acid solution samples in which the coated layer was dissolved were quantitatively measured by inductively coupled plasma emission spectroscopy (ICP-AES), to determine the coating weight and the coating weight of Zn of the steel sheet for hot pressing.

<Hot-Dip Coating>

Zn—Al-based coated steel sheets for hot pressing of Nos. 21 to 27, shown in Table 1-1, were produced as follows. In a hot-dip coating line, the cold rolled steel sheet was immersed in a hot-dip Zn—Al(—Mg)-based coating bath and subsequently subjected to $N_2$ gas wiping. The Zn-based coated layers having different coating weights for the front and back surfaces of the steel sheet were produced by adjusting the flow rate of the wiping gas for each of the surfaces. Regarding Zn—Al-based coated steel sheets of Nos. 23 and 24, shown in Table 1-1, the production was carried out by performing an alloying treatment on the steel sheets for hot pressing provided with the hot-dip Zn—Al coating, by heating the steel sheets to 500° C. with a Joule heating device. The coating weight of Zn in the Zn-based coated layer on each of the surfaces of the steel sheet for hot pressing was measured as follows. The steel sheet for hot pressing to be evaluated was blanked to give three samples (φ=48 mm), and each of the samples was weighed. Subsequently, in each of the samples, a non-evaluation surface, which was opposite to the surface for which the coating weight of Zn was to be evaluated, was masked. Subsequently, the samples were immersed in a solution for 10 minutes. The solution was one obtained by diluting 500 mL of a 35% aqueous hydrochloric acid solution, which contained 3.5 g of hexamethylenetetramine added thereto, to 1 L. In this manner, the Zn-based coated layer was dissolved. Thereafter, each of the samples was weighed again. The metal components in the hydrochloric acid solution samples in which the coated layer was dissolved were quantitatively measured by inductively coupled plasma emission spectroscopy (ICP-AES), to determine the coating weight and the coating weight of Zn of the steel sheet for hot pressing.

<Production of Hot-Pressed Member>

Subsequently, from each of the steel sheets for hot pressing resulting from the coating treatment described above, a 100 mm×200 mm test specimen was cut. Thereafter, a heat treatment was performed thereon in an electric furnace or by Joule heating. The heat treatment conditions (heating temperature, heating time, holding temperature, and holding time) are shown in Table 1-2. The heat-treated test specimen was removed from the electric furnace or the Joule-heating furnace and was immediately hot-pressed with a hat-shaped die at a forming start temperature of 700° C. In this manner, a hot-pressed member was produced. A shape of the produced hot-pressed member was as follows: a planar portion on an upper side had a length of 100 mm, a planar portion on a lateral side had a length of 50 mm, and a planar portion on a lower side had a length of 50 mm. Furthermore, in the die, both shoulders of an upper side and both shoulders of a lower side all had a bending radius of 7R.

Regarding the produced hot-pressed members, the coating weight, the coating weight of Zn, and the average line roughness Ra were measured, and the resistance spot weldability and the post-coating corrosion resistance were evaluated.

<Measurement of Coating Weight, Coating Weight of Zn, and Average Line Roughness Ra>

The coating weight, the coating weight of Zn, and the average line roughness Ra of the produced hot-pressed members were measured, and their film structures were evaluated. The coating weight and the coating weight of Zn of the hot-pressed member were determined in the following manner. The hot-pressed member to be evaluated was blanked to give three samples (φ=48 mm), and each of the samples was weighed. Subsequently, in each of the samples, a non-evaluation surface, which was opposite to the surface for which the coating weight of Zn was to be evaluated, was masked. Subsequently, the samples were immersed in a solution for 60 minutes. The solution was one obtained by diluting 20 g of ammonium dichromate to 1 L. In this manner, an oxide layer was exclusively dissolved. Subsequently, the samples were immersed in a solution for 10 minutes. The solution was one obtained by diluting 500 mL of a 35% aqueous hydrochloric acid solution, which contained 3.5 g of hexamethylenetetramine added thereto, to 1 L. In this manner, the Zn-based coated layer was dissolved. Thereafter, each of the samples was weighed again. The metal components in the hydrochloric acid solution samples in which the coated layer was dissolved were quantitatively measured by inductively coupled plasma emission spectroscopy (ICP-AES), to determine the coating weight and the coating weight of Zn of the hot-pressed member.

An arithmetic average roughness Ra of the surface of the Zn-based coated layers was measured with a Surftest SJ-2100, manufactured by Mitutoyo, in accordance with JIS B 0601-2001. The scan speed was 0.5 mm/second, the operating distance was 4 mm, and the measurement load was 0.75 mN. The measurement was conducted on randomly selected 30 zones, and an average of the results was calculated and designated as the average line roughness Ra of the disclosed embodiments.

<Resistance Spot Weldability>

To evaluate the resistance spot weldability of the hot-pressed member, resistance spot weld was performed on a sheet combination of two same pieces, which were 30 mm×50 mm test specimens cut from the planar portion on the upper side of the produced hot-pressed member. The welding machine used was an AC resistance spot welding machine, and the electrodes used were Cr—Cu electrodes φ16 DR type, tip diameter: 6 mm). An electrode force was 3.5 kN, and the welding time was 0.42 seconds. The welding current was increased from 3.0 kA in increments of 0.1 kA until splash was generated, and the maximum current value at which splash was not generated was recorded. After the welding, a cross section of the weld of the test specimens was observed to measure a nugget diameter of the weld, and a welding appropriate current range was determined as the difference between the minimum current at which the nugget diameter was $4\sqrt{t}$ (mm) or greater, where t (mm) was the sheet thickness, and the maximum current value at which splash was not generated. The appropriate current range was rated according to the following criteria. "◎" and "○" indicate "pass". The evaluation results are shown in Table 1-2.

◎: 1.5 kA≤appropriate current range

○: 0.8 kA≤appropriate current range<1.5 kA x: 0.8 kA>appropriate current range

Additionally, welding was performed on a sheet combination of two same pieces, under the same conditions as those described above, except that an electrode angle of 5° was provided. A maximum length of cracks that were formed within the nugget was measured from a cross section and designated as a "weld LME crack length". The weld LME crack length was rated according to the following criteria. "○" indicates "pass". The evaluation results are shown in Table 1-2.

○: 20 μm≥weld LME crack length

Δ: 100 μm≥weld LME crack length>20 μm x: 100 μm<weld LME crack length

<Post-Coating Corrosion Resistance>

To evaluate the post-coating corrosion resistance of the hot-pressed member, a zirconium-based chemical conversion treatment and electrodeposition coating were performed on a 70 mm×150 mm test specimen, which was cut from the planar portion on the upper side of the produced hot-pressed member. The zirconium-based chemical conversion treatment was performed with a PLM 2100, manufactured by Nihon Parkerizing Co., Ltd., under standard conditions. The electrodeposition coating was performed with a cationic electrodeposition coating paint Electron GT-100, manufactured by Kansai Paint Co., in a manner such that the coating had a film thickness of 10 μm, and the baking conditions used included a holding temperature of 170° C. and a holding time of 20 minutes. Subsequently, the hot-pressed member that underwent the zirconium-based chemical conversion treatment and electrodeposition coating was subjected to a corrosion test (SAE-J2334), and after 30 cycles, a state of corrosion was evaluated.

The non-cross-cut general area was rated according to the following criteria. "◎" and "○" indicate "pass". The evaluation results are shown in Table 1-2.

◎: No red rust formation in the general area

○: 1≤number of regions in which red rust was formed<3

Δ: 3≤number of regions in which red rust was formed<10 x: 10≤number of regions in which red rust was formed

For a cross-cut area (flawed area), a maximum one-side blistering width from the cross cut was measured, and a rating was performed according to the following criteria. "◎" and "○" indicate "pass". The evaluation results are shown in Table 1-2.

◎: Maximum one-side blistering width<1.5 mm

○: 1.5 mm≤maximum one-side blistering width<3.0 mm

Δ: 3.0 mm≤maximum one-side blistering width<4.0 mm x: 4.0 mm≤maximum one-side blistering width

TABLE 1-1

| | Steel sheet for hot pressing | | | | | |
|---|---|---|---|---|---|---|
| | Front surface | | | Back surface | | |
| Steel sheet Nos. | Coated layer (mass %) | Coating weight g/m$^2$ | Coating weight of Zn g/m$^2$ | Coated layer (mass %) | Coating weight g/m$^2$ | Coating weight of Zn g/m$^2$ |
| Steel sheet 1 | Zn-12% Ni | 5 | 4 | Zn-12% Ni | 5 | 4 |
| Steel sheet 2 | Zn-12% Ni | 10 | 9 | Zn-12% Ni | 10 | 9 |
| Steel sheet 3 | Zn-12% Ni | 20 | 18 | Zn-12% Ni | 20 | 18 |
| Steel sheet 4 | Zn-12% Ni | 30 | 26 | Zn-12% Ni | 30 | 26 |
| Steel sheet 5 | Zn-12% Ni | 45 | 40 | Zn-12% Ni | 45 | 40 |
| Steel sheet 6 | Zn-12% Ni | 70 | 62 | Zn-12% Ni | 70 | 62 |
| Steel sheet 7 | Zn-12% Ni | 5 | 4 | Zn-12% Ni | 45 | 40 |
| Steel sheet 8 | Zn-12% Ni | 20 | 18 | Zn-12% Ni | 45 | 40 |

TABLE 1-1-continued

| | Steel sheet for hot pressing | | | | | |
|---|---|---|---|---|---|---|
| | Front surface | | | Back surface | | |
| Steel sheet Nos. | Coated layer (mass %) | Coating weight g/m$^2$ | Coating weight of Zn g/m$^2$ | Coated layer (mass %) | Coating weight g/m$^2$ | Coating weight of Zn g/m$^2$ |
| Steel sheet 9 | Zn-12% Ni | 20 | 18 | Zn-12% Ni | 70 | 62 |
| Steel sheet 10 | Zn-12% Ni | 20 | 18 | Zn-12% Ni | 70 | 62 |
| Steel sheet 11 | Zn-12% Ni | 20 | 18 | Zn-12% Ni | 70 | 62 |
| Steel sheet 12 | Zn-12% Ni | 20 | 18 | Zn-12% Ni | 70 | 62 |
| Steel sheet 13 | Zn-12% Ni | 20 | 18 | Zn-12% Ni | 70 | 62 |
| Steel sheet 14 | Zn-12% Ni | 20 | 18 | Zn-12% Ni | 70 | 62 |
| Steel sheet 15 | Zn-12% Ni | 20 | 18 | Zn-12% Ni | 100 | 88 |
| Steel sheet 16 | Zn-12% Ni | 35 | 31 | Zn-12% Ni | 45 | 40 |
| Steel sheet 17 | Zn-12% Ni | 35 | 31 | Zn-12% Ni | 70 | 62 |
| Steel sheet 18 | Zn-12% Ni | 35 | 31 | Zn-12% Ni | 100 | 88 |
| Steel sheet 19 | Zn | 60 | 60 | Zn | 60 | 60 |
| Steel sheet 20 | Zn | 20 | 20 | Zn | 60 | 60 |
| Steel sheet 21 | Zn-0.2% Al | 45 | 45 | Zn-0.2% Al | 50 | 50 |
| Steel sheet 22 | Zn-0.2% Al | 27 | 27 | Zn-0.2% Al | 50 | 50 |
| Steel sheet 23 | Zn-0.2% Al-10% Fe | 50 | 45 | Zn-0.2% Al-10% Fe | 56 | 50 |
| Steel sheet 24 | Zn-0.2% Al-10% Fe | 30 | 27 | Zn-0.2% Al-10% Fe | 56 | 50 |
| Steel sheet 25 | Zn-5% Al | 28 | 27 | Zn-5% Al | 53 | 50 |
| Steel sheet 26 | Zn-5% Al-0.5% Mg | 28 | 27 | Zn-5% Al-0.5% Mg | 53 | 50 |
| Steel sheet 27 | Zn-6% Al-3% Mg | 30 | 27 | Zn-6% Al-3% Mg | 55 | 50 |

TABLE 1-2

| | | | Heat treatment conditions for hot pressing | | | | Hot-pressed members | | | Evaluation results of hot-pressed members | | | | |
|---|---|---|---|---|---|---|---|---|---|---|---|---|---|---|
| | | | | | | | Front surface | | | Resistance spot weldability | | Post-coating corrosion resistance | | |
| Nos. | Steel sheet Nos. | Method | Heating temperature ° C. | Heating time s | Holding temperature ° C. | Holding time* s | Coating weight of Zn g/m$^2$ | Ra μm | Ra μm | Appropriate current range | LME crack | General area | Flawed area | Notes |
| 1 | Steel sheet 1 | Electric furnace | 900 | 180 | 900 | 0 | 0 | 0.8 | 0.8 | X | ○ | ◎ | X | Comparative Example |
| 2 | Steel sheet 2 | Electric furnace | 900 | 180 | 900 | 0 | 3 | 1.0 | 1.0 | X | ○ | ◎ | Δ | Comparative Example |
| 3 | Steel sheet 3 | Electric furnace | 900 | 180 | 900 | 0 | 12 | 1.5 | 1.5 | X | ○ | ◎ | ○ | Comparative Example |
| 4 | Steel sheet 4 | Electric furnace | 900 | 180 | 900 | 0 | 20 | 2.3 | 2.3 | X | ○ | ○ | ○ | Comparative Example |
| 5 | Steel sheet 5 | Electric furnace | 900 | 180 | 900 | 0 | 34 | 3.0 | 4.0 | ○ | Δ | Δ | ◎ | Comparative Example |
| 6 | Steel sheet 6 | Electric furnace | 900 | 180 | 900 | 0 | 56 | 4.5 | 4.5 | ◎ | X | X | ◎ | Comparative Example |
| 7 | Steel sheet 7 | Electric furnace | 900 | 180 | 900 | 0 | 0 | 0.8 | 4.0 | ○ | ○ | ◎ | X | Comparative Example |
| 8 | Steel sheet 8 | Electric furnace | 900 | 180 | 900 | 0 | 12 | 1.5 | 4.0 | ○ | ○ | ◎ | ○ | Example |
| 9 | Steel sheet 9 | Electric furnace | 900 | 180 | 900 | 0 | 12 | 1.5 | 4.0 | ◎ | ○ | ◎ | ○ | Example |
| 10 | Steel sheet 10 | Electric furnace | 900 | 180 | 900 | 120 | 10 | 1.4 | 4.0 | ◎ | ○ | ◎ | ○ | Example |
| 11 | Steel sheet 11 | Electric furnace | 900 | 180 | 900 | 240 | 8 | 1.3 | 4.0 | ○ | ○ | ○ | ○ | Example |
| 12 | Steel sheet 12 | Electric furnace | 900 | 180 | 900 | 360 | 4 | 1.2 | 4.0 | X | ○ | X | ○ | Comparative Example |
| 13 | Steel sheet 13 | Joule heating | 900 | 15 | 900 | 0 | 12 | 1.8 | 4.5 | ◎ | ○ | ◎ | ○ | Example |
| 14 | Steel sheet 14 | Electric furnace | 1050 | 180 | 1050 | 0 | 0 | 0.8 | 0.8 | X | ○ | ◎ | X | Comparative Example |
| 15 | Steel sheet 15 | Electric furnace | 900 | 180 | 900 | 0 | 12 | 1.5 | 5.5 | ◎ | ○ | ◎ | ○ | Example |
| 16 | Steel sheet 16 | Electric furnace | 900 | 180 | 900 | 0 | 25 | 2.3 | 4.0 | ○ | ○ | ○ | ◎ | Example |
| 17 | Steel sheet 17 | Electric furnace | 900 | 180 | 900 | 0 | 25 | 2.3 | 4.0 | ◎ | ○ | ○ | ◎ | Example |
| 18 | Steel sheet 18 | Electric furnace | 900 | 180 | 900 | 0 | 25 | 2.3 | 5.5 | ◎ | ○ | ○ | ◎ | Example |
| 19 | Steel sheet 19 | Electric furnace | 900 | 180 | 900 | 0 | 54 | 4.0 | 4.0 | ○ | X | Δ | ◎ | Comparative Example |

TABLE 1-2-continued

| | | | Heat treatment conditions for hot pressing | | | | Hot-pressed members | | | Evaluation results of hot-pressed members | | | | |
|---|---|---|---|---|---|---|---|---|---|---|---|---|---|---|
| | | | | | | | Front surface | | Back surface | Resistance spot weldability | | Post-coating corrosion resistance | | |
| Nos. | Steel sheet Nos. | Method | Heating temperature ° C. | Heating time s | Holding temperature ° C. | Holding time* s | Coating weight of Zn g/m$^2$ | Ra μm | Ra μm | Appropriate current range | LME crack | General area | Flawed area | Notes |
| 20 | Steel sheet 20 | Electric furnace | 900 | 180 | 900 | 0 | 14 | 1.5 | 4.0 | ◎ | ○ | ◎ | ○ | Example |
| 21 | Steel sheet 21 | Electric furnace | 900 | 180 | 900 | 0 | 39 | 4.0 | 4.0 | ○ | X | Δ | ◎ | Comparative Example |
| 22 | Steel sheet 22 | Electric furnace | 900 | 180 | 900 | 0 | 21 | 2.3 | 4.0 | ○ | ○ | ○ | ◎ | Example |
| 23 | Steel sheet 23 | Electric furnace | 900 | 180 | 900 | 0 | 39 | 4.0 | 4.0 | ○ | X | Δ | ◎ | Comparative Example |
| 24 | Steel sheet 24 | Electric furnace | 900 | 180 | 900 | 0 | 21 | 2.3 | 4.0 | ○ | ○ | ○ | ◎ | Example |
| 25 | Steel sheet 25 | Electric furnace | 900 | 180 | 900 | 0 | 21 | 2.3 | 4.0 | ○ | ○ | ○ | ◎ | Example |
| 26 | Steel sheet 26 | Electric furnace | 900 | 180 | 900 | 0 | 21 | 2.3 | 4.0 | ○ | ○ | ○ | ◎ | Example |
| 27 | Steel sheet 27 | Electric furnace | 900 | 180 | 900 | 0 | 21 | 2.3 | 4.0 | ○ | ○ | ○ | ◎ | Example |

*"0 seconds" means that the holding was omitted.

The results shown in Table 1-2 demonstrate that the hot-pressed members of the disclosed embodiments have excellent post-coating corrosion resistance and excellent resistance spot weldability. Furthermore, the steel sheets for hot pressing of the disclosed embodiments enable the production of a hot-pressed member having excellent post-coating corrosion resistance and excellent resistance spot weldability.

The invention claimed is:

1. A hot-pressed member comprising:

a Zn-based coated layer disposed on a first side of a steel sheet; and a Zn-based coated layer disposed on a second side of the steel sheet, wherein a coating weight of Zn in the Zn-based coated layer on the first side of the steel sheet is in a range of 5 to 35 g/m$^2$, and an average line roughness Ra of a surface of the Zn-based coated layer on the first side is less than or equal to 2.5 μm, and an average line roughness Ra of a surface of the Zn-based coated layer on the second side of the steel sheet is greater than or equal to 3.5 μm.

2. A method for manufacturing the hot-pressed member according to claim 1, the method comprising:

providing the steel sheet for hot pressing, the steel sheet for hot pressing including the Zn-based coated layer on the first side of the steel sheet and including the Zn-based coated layer on the second side of the steel sheet, the coating weight of Zn in the Zn-based coated layer on the first side of the steel sheet is in the range of 5 to 35 g/m$^2$, and a coating weight of Zn in the Zn-based coated layer on the second side of the steel sheet is in a range of 40 to 120 g/m$^2$;

heating the steel sheet from room temperature to a temperature range of an $Ac_3$ transformation temperature to 1000° C. in a period in a range of 5 seconds or more and 600 seconds or less;

holding the steel sheet within the temperature range of the $Ac_3$ transformation temperature to 1000° C. for a period of 300 seconds or less; and subsequently hot-pressing the steel sheet.

* * * * *